US012331493B2

(12) United States Patent
Dederian

(10) Patent No.: US 12,331,493 B2
(45) Date of Patent: Jun. 17, 2025

(54) GREYWATER CAPTURE AND CONTROL SYSTEM

(71) Applicant: Richard Dederian, Redding, CA (US)

(72) Inventor: Richard Dederian, Redding, CA (US)

( * ) Notice: Subject to any disclaimer, the term of this patent is extended or adjusted under 35 U.S.C. 154(b) by 0 days.

(21) Appl. No.: 18/917,475

(22) Filed: Oct. 16, 2024

(65) Prior Publication Data

US 2025/0122700 A1 Apr. 17, 2025

Related U.S. Application Data

(60) Provisional application No. 63/591,101, filed on Oct. 17, 2023.

(51) Int. Cl.
*E03B 1/04* (2006.01)

(52) U.S. Cl.
CPC ..... *E03B 1/041* (2013.01); *E03B 1/042* (2013.01); *E03B 2001/045* (2013.01); *Y10T 137/6969* (2015.04)

(58) Field of Classification Search
CPC ..... E03B 1/042; E03B 2001/045; Y10T 137/6969
See application file for complete search history.

(56) References Cited

U.S. PATENT DOCUMENTS 5,345,625 A * 9/1994 Diemand ..... E03C 1/00 4/665
5,452,956 A 9/1995 Gilliam
5,845,346 A * 12/1998 Johnson, Jr. ..... E03B 1/04 4/665
6,139,729 A * 10/2000 Gonzalez, Jr. ..... E03B 1/04 210/170.08
6,314,590 B1 * 11/2001 Lee ..... E03D 5/003 4/597

(Continued)

FOREIGN PATENT DOCUMENTS

AU 2006100683 A4 9/2006
AU 2006249234 A1 6/2007

(Continued)

OTHER PUBLICATIONS

Hydraloop, Home | Hydraloop | EN | Greywater Recycling | Use Water Twice, accessed Aug. 7, 2024, www.hydraloop.com.

(Continued)

*Primary Examiner* — Kevin F Murphy
(74) *Attorney, Agent, or Firm* — Thompson Patent Law Offices PC

(57) ABSTRACT

Apparatus and associated methods relate to a greywater capture and control system. In an illustrative example, the greywater capture and control system may, for example, include an ingress pumping module having a suction line. The suction line may, for example, fluidly couple a pump inlet to an existing drain port of a water dispensing appliance. The ingress pumping module may, for example, be configured such that, in response to flow accumulation in the drain port, the ingress pumping module automatically applies negative pressure to the drain port to divert the outflow of the drain port from existing drain plumbing to a greywater reservoir. Various embodiments may advantageously provide a distributed network of local, modular greywater monitoring and control systems.

15 Claims, 9 Drawing Sheets

(56) References Cited

U.S. PATENT DOCUMENTS

| | | | | |
|---|---|---|---|---|
| 8,066,029 | B2 * | 11/2011 | McDonald | E03B 7/071 137/593 |
| 8,241,009 | B2 * | 8/2012 | Platteel | E03B 1/042 417/63 |
| 8,375,481 | B1 * | 2/2013 | Gibbins | E03B 1/042 4/663 |
| 9,074,355 | B2 * | 7/2015 | Jallon | E03C 1/00 |
| 9,970,184 | B2 | 5/2018 | Green | |
| 2004/0050429 | A1 | 3/2004 | Aylward et al. | |
| 2013/0025686 | A1 * | 1/2013 | Norton | F04B 37/14 137/1 |
| 2021/0206657 | A1 | 7/2021 | Vielma | |
| 2023/0183962 | A1 * | 6/2023 | Han | E03D 5/003 4/353 |

FOREIGN PATENT DOCUMENTS

| | | | | |
|---|---|---|---|---|
| AU | 2007100768 | A4 | 9/2007 | |
| BR | 102014024842 | A2 | 5/2016 | |
| BR | 202020018919 | Y1 | 12/2021 | |
| CN | 201082971 | Y | 7/2008 | |
| CN | 208604695 | U | 3/2019 | |
| EP | 4150166 | A1 | 3/2023 | |
| JP | S5825017 | Y | 5/1983 | |
| JP | S5835747 | Y | 8/1983 | |
| JP | H10219783 | A | 8/1998 | |
| JP | H11104025 | A | 4/1999 | |
| WO | 2018069844 | A1 | 4/2018 | |
| WO | WO-2021228918 | A1 * | 11/2021 | E03B 1/041 |
| WO | 2024079447 | A1 | 4/2024 | |

OTHER PUBLICATIONS

ISG, Instrumentation Service Group | Trinity Remote Monitoring, accessed Aug. 7, 2024, www.isg-us.com.

Mopeka Store Amazon, Mopeka Pro Check Sensor—Wireless Propane Tank Magnetic Sensor Level Indicator—Propane Gas Tank Pressure Gauge Electronic for BBQ Grill—Remote Ready Propane, Butane and Fuel Level Gauge with App, accessed Aug. 7, 2024, www.amazon.com/gp/aw/d/B09J6MXJKT/?encoding=UTF8&pd_rd_plhdr=t&aaxitk=a3471a4e430d729120e2664189df300b&hsa_cr_id=0&qid=1723057841&sr=1-1-9e67e56a-6f64-441f-a281-df67fc737124&ref_=sbx_be_s_sparkle_lsi4d_asin_0_img&pd_rd_w=fqGd5&content-.

Mopeka, Mopeka Pro Check-Water Sensor (Bottom Mount w/Collar)—Currently Out—See Pro Check Universal for Aluminum Tanks in the meantime, accessed Aug. 7, 2024, www.mopeka.com/product/mopeka-pro-check-water-sensor-bottom-mount-w-collar.

RecPro, RV Water Tank Probe Sensors 6 Pack, accessed Aug. 8, 2024, www.recpro.com/rv-water-tank-probe-sensors-6-pack.

RV Life Pro, Gray water sensor—iRV2 Forums, accessed Aug. 7, 2024, www.irv2.com/forums/f106/gray-water-sensor-576306.html.

Water Wise Group, Greywater Systems & How You Can Use Them, accessed Aug. 7, 2024, www.waterwisegroup.com/greywater-education/how-can-i-use-greywater.

* cited by examiner

GREYWATER CAPTURE AND CONTROL SYSTEM

CROSS-REFERENCE TO RELATED APPLICATIONS

This application claims the benefit of U.S. Application Ser. No. 63/591,101, titled "a novel hardware and software based automatic greywater device for gathering greywater, monitoring and distributing greywater to non-potable & non-drinking destinations", filed by Richard Dederian on Oct. 17, 2023.

This application incorporates the entire contents of the foregoing application herein by reference.

TECHNICAL FIELD

Various embodiments relate generally to water distribution and plumbing.

BACKGROUND

Modern plumbing has developed from historical techniques of water distribution and waste management. Plumbers have traditionally selected from among widely available materials for constructing buildings for commercial or residential purposes.

Plumbing materials, both for water supply and drainage systems may, for example, have included some substances like clay, lead, copper, iron, PVC, and/or PEX.

Piping is a material that may be used to transport fluids internally within a building. Pipes have properties that make them important in water transfer. Properties may, for example, include a combination of positive pressure and gravity within a plumbing system. Water may, for example, enter a plumbing system from a pressurized source such as municipal supply.

SUMMARY

Apparatus and associated methods relate to a greywater capture and control system. In an illustrative example, the greywater capture and control system may, for example, include an ingress pumping module having a suction line. The suction line may, for example, fluidly couple a pump inlet to an existing drain port of a water dispensing appliance. The ingress pumping module may, for example, be configured such that, in response to flow accumulation in the drain port, the ingress pumping module automatically applies negative pressure to the drain port to divert the outflow of the drain port from existing drain plumbing to a greywater reservoir. Various embodiments may advantageously provide a distributed network of local, modular greywater monitoring and control systems.

Various embodiments may achieve one or more advantages. The greywater capture and control system may, for example, include a greywater monitoring and distribution control system. The greywater capture and control system may, for example, include one or more self-contained greywater device. The greywater capture and control system may, for example, advantageously be installed within minutes. The greywater capture and control system may, for example, provide an economically accessible greywater device. The greywater capture and control system may, for example, advantageously enable communities, households, and/or businesses to participate in the benefits of recycling greywater.

The greywater capture and control system may, for example, advantageously consolidate numerous functions into a self-contained device. The greywater capture and control system may, for example, advantageously be installed (e.g., for greywater recycling) without plumbing modifications (e.g., without modification to structure of existing drain plumbing). The greywater capture and control system may, for example, advantageously provide a ready installation process including drop-in fluid intake modules may, for example, advantageously provide a ready installation process with a drop-in-modular design to accommodate a multiple of configurations and physical layouts. The greywater capture and control system may, for example, advantageously incorporate Internet of things (IoT) technology communicably connecting sensors and hardware to a controller (e.g., computer processing unit (CPU)) to cooperate with predetermine software engine modules.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary greywater capture and control system is introduced with reference to FIGS. 1-3. Second, that introduction leads to a description with reference to FIGS. 4-7 of some exemplary block diagrams of portions of the greywater capture and control system. FIGS. 8-11 depict some exemplary greywater capture and control method(s) of operation.

Figure 1:
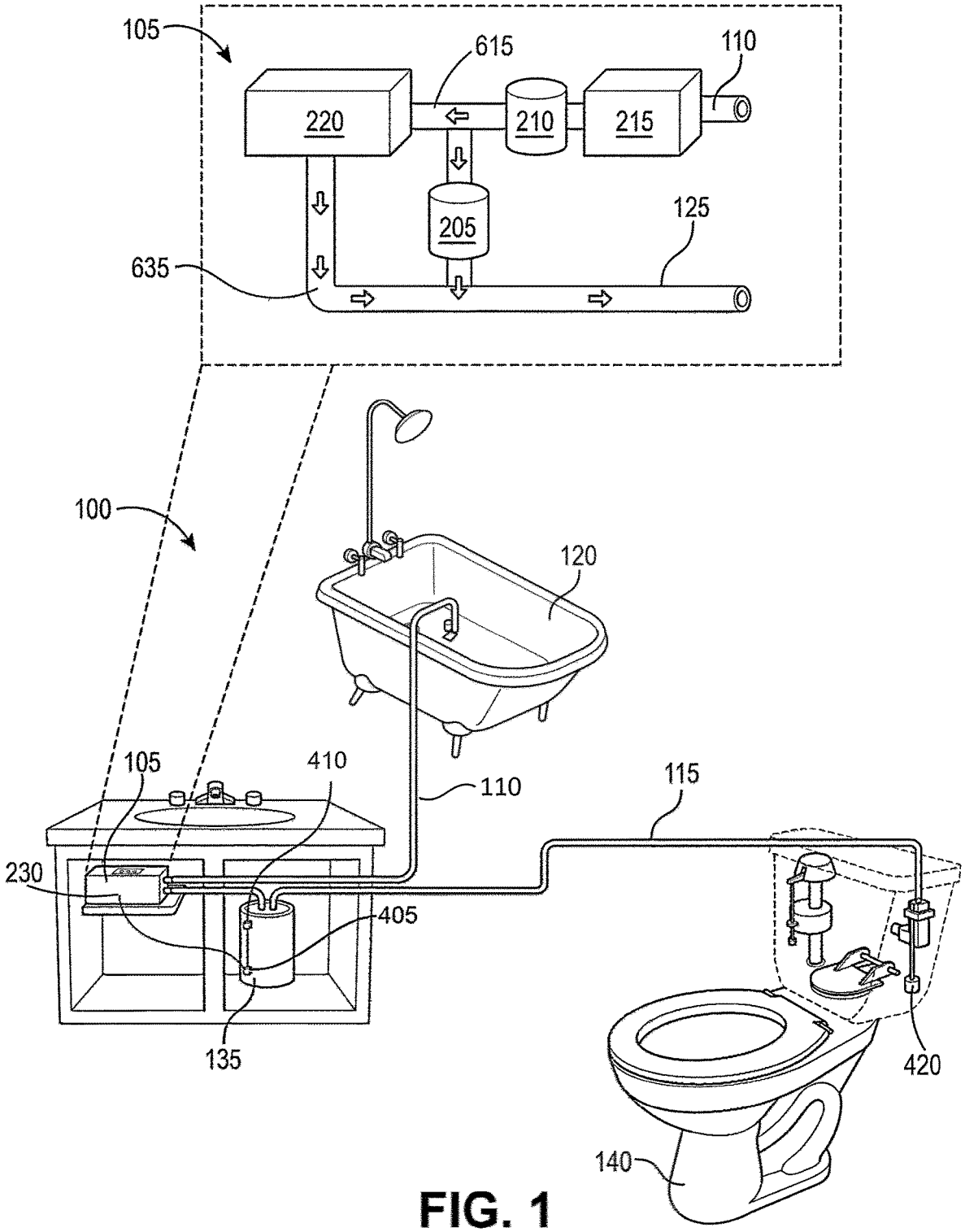
FIG. 1 depicts an exemplary greywater capture and control system employed in an illustrative use-case scenario.
Figure 2:
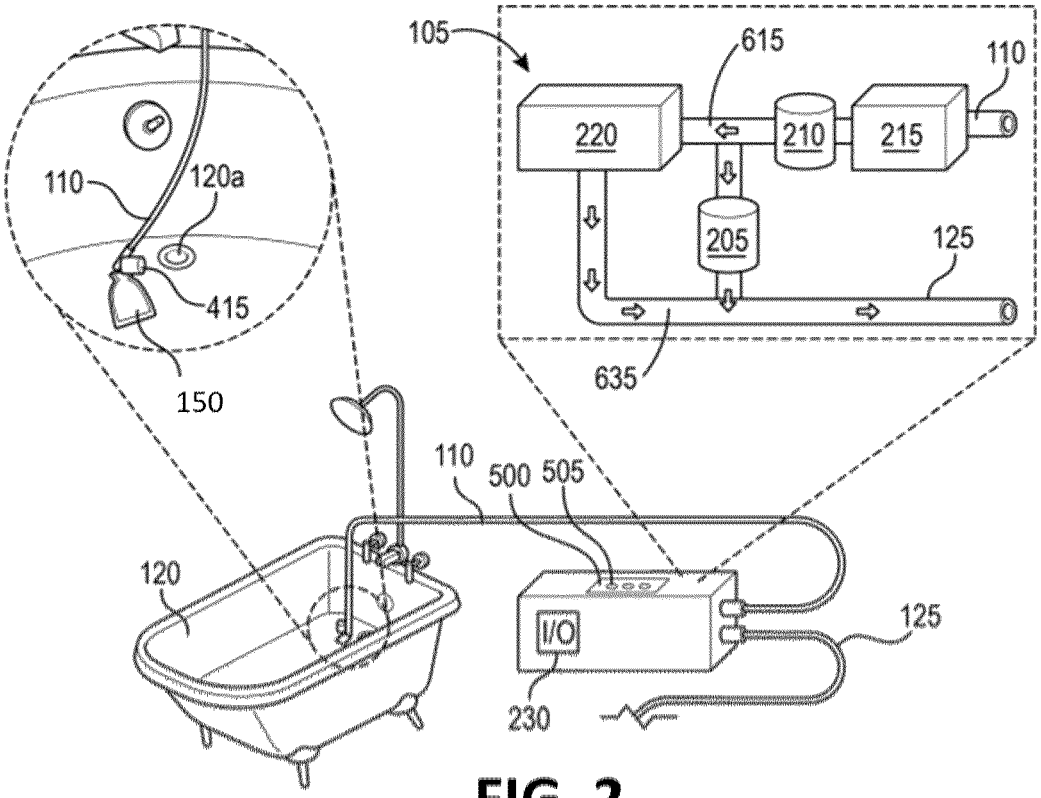
FIG. 2 is a schematic depicting an exemplary greywater capture and control ingress system.

FIG. 1 depict an exemplary greywater capture and control system employed in an illustrative use-case scenario 100. FIG. 2 is a schematic depicting an exemplary greywater capture and control ingress system. The fluid greywater capture and control system may, for example, include a fluid distribution system.

In some embodiments, the greywater capture and control system include one or more of four sub-systems: 1) ingress 2) egress 3) automation, and/or a 4) sensor system. The ingress system may, for example, be configured as a suction system, such as for draw-in of greywater. The ingress system may, for example, provide drain functionality in a water dispensing appliance such as, for example, in a shower and/or a sink.

Figure 7:
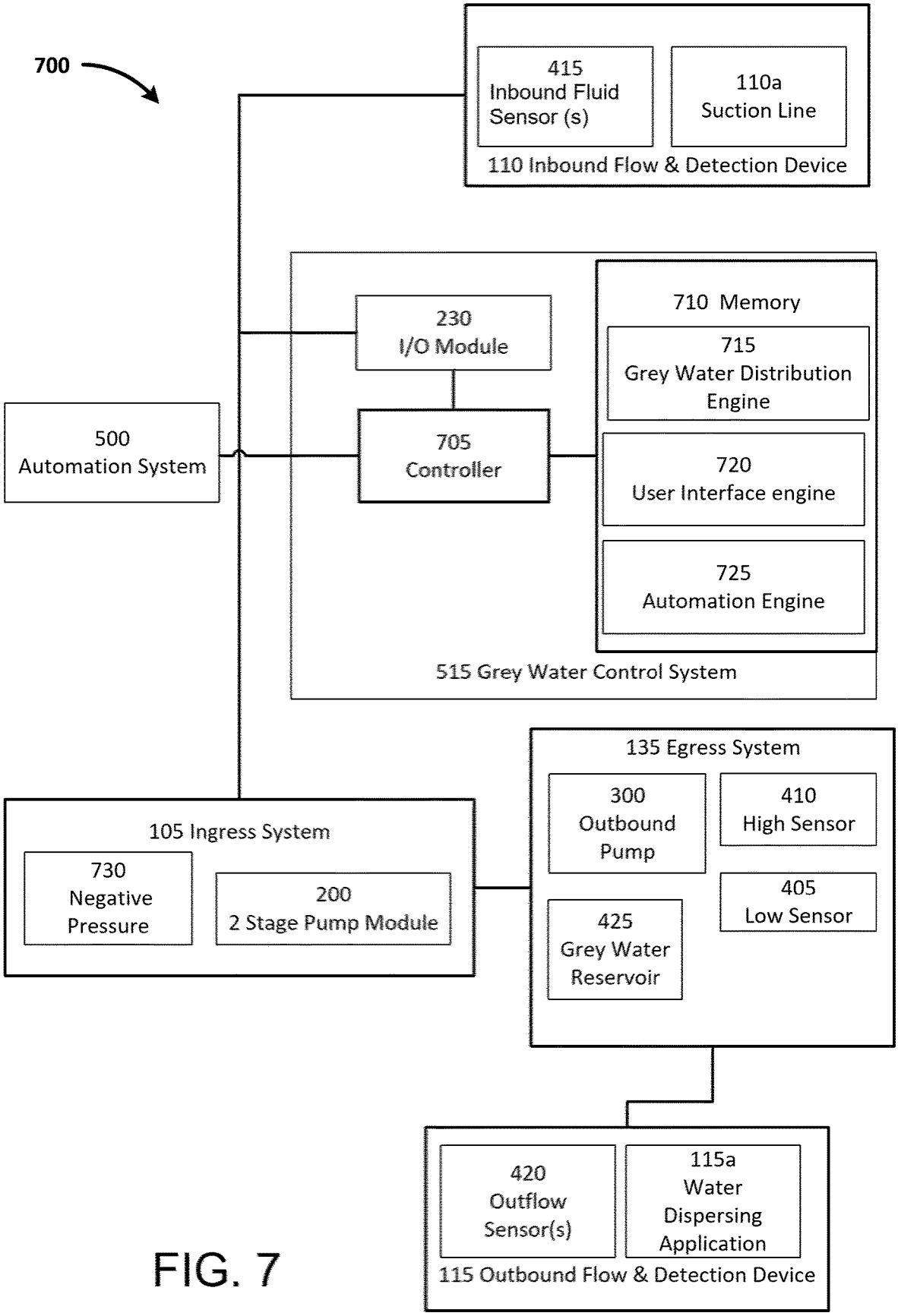
FIG. 7 depicts an exemplary greywater capture and control system block diagram.

The illustrative use-case scenario 100 includes a water dispensing appliance 120 (e.g., a shower). In an illustrative aspect, the process begins as water flows and collects in the water dispensing appliance 120 (e.g., a greywater source). After the water collects to a predetermined water level (e.g., in the shower), the fluid is detected by an inbound fluid sensor 415, as depicted in FIG. 2. The water level may, for example, be defined by a height parameter of the water. In this example, the inbound fluid sensor includes at least one sensor (e.g., pressure, sonar, fluid pressure sensor, light, optical, IR). The inbound fluid sensor may, for example, include a combination of sensors (e.g., IR and sonar). The illustrative use-case scenario 100 includes an inbound flow and detection device 110. The inbound flow & detection device includes a suction line 110*a* (as depicted in FIG. 7). The inbound flow & detection device includes at least one inbound fluid sensor 415. The inbound flow & sensor device is coupled to a weight 150 coupled to the suction line. The weight may, for example, include a medium grain filter. The weight may, for example, include some material with mass configured to set the inbound flow & signal device in place. The inbound flow & sensor device is placed near the grey water drain source drain 120*a*.

Figure 6:
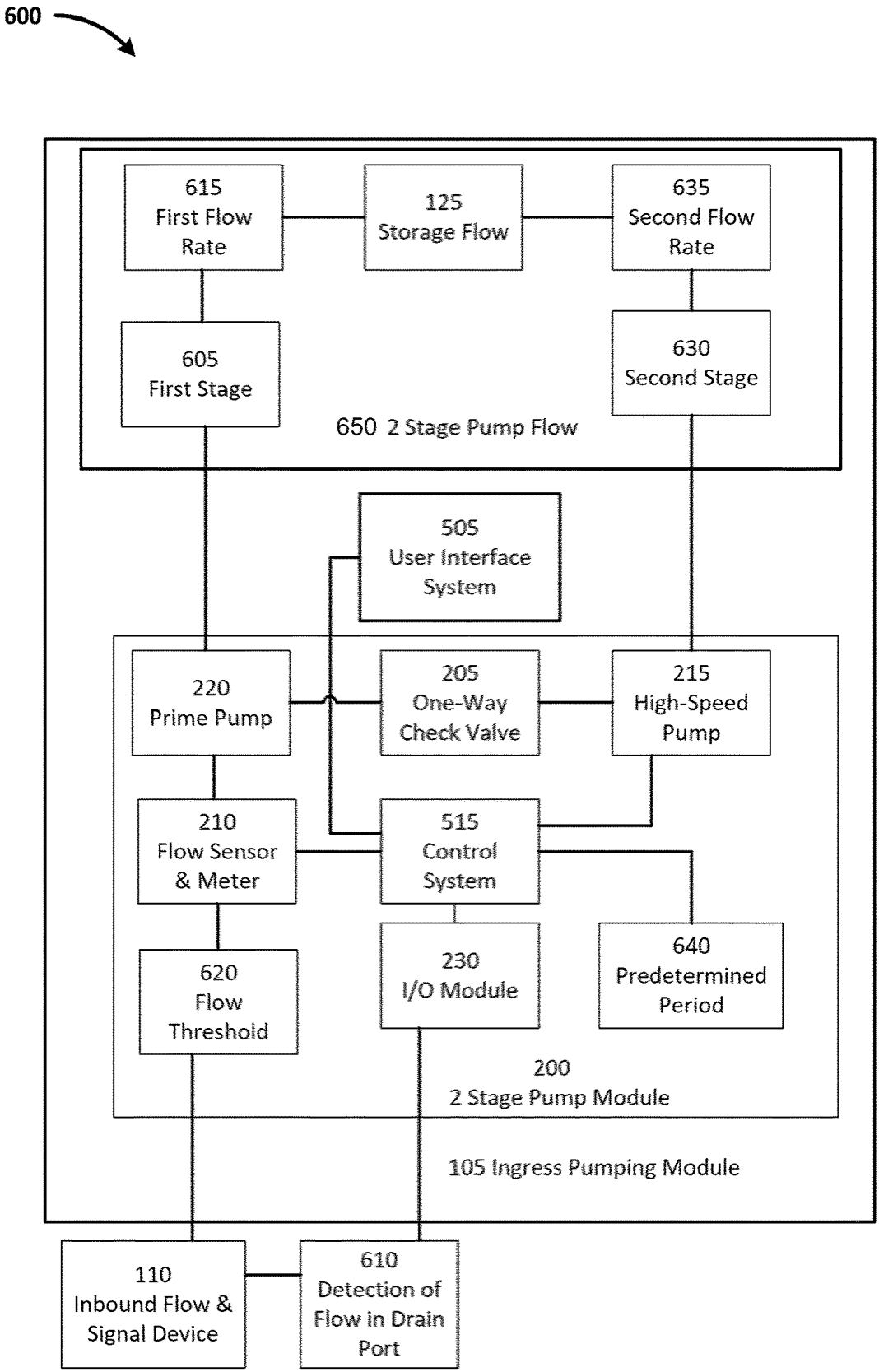
FIG. 6 depicts an exemplary greywater capture and control block diagram.
Figure 9:
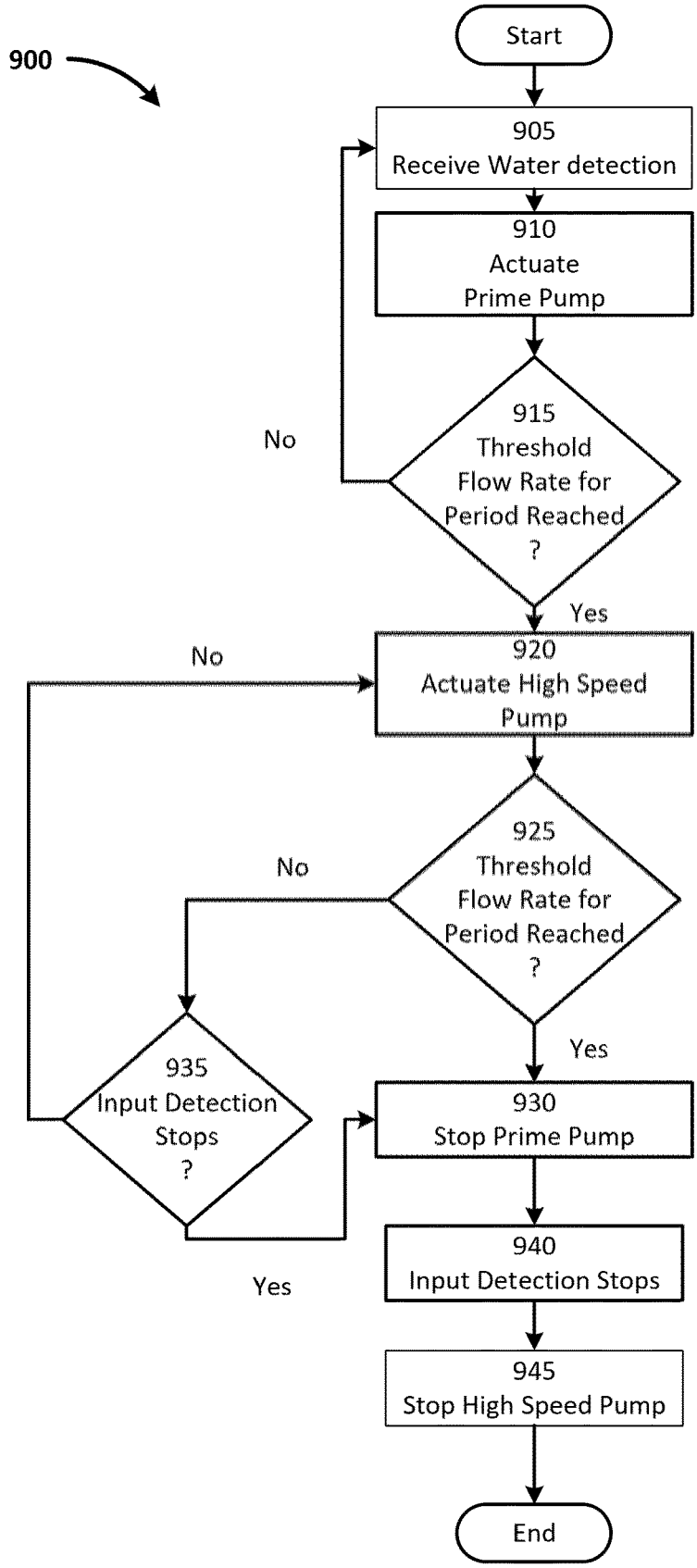
FIG. 9 depicts a process for controlling the operation of the prime and high-speed pumps in the greywater system.

After reaching a predetermined height and/or detecting water flow, the inbound fluid sensor 415 may, for example, send a signal to the control system 515 (system depicted in FIG. 6, process depicted in FIG. 9). After receiving the signal, the ingress system 105 activates an ingress system's prime pump 220.

The ingress pumping module 105 includes a 2 stage pump module 200. The pump module 200 may, for example, include multiple stages such that the 2 stage pump module 200 is a multi-stage pump module (e.g., a two-stage pump module as depicted in FIG. 6). In some embodiments, the ingress pumping modules may, for example, include other types of pumping modules. As shown, the ingress pumping module 105 includes a flow sensor and meter 210. In some embodiments, the system may, for example, include an additional ultrasonic sensor to mitigate against debris. The ultrasonic sensors may, for example, perform detection routines for debris. Debris may, for example, include hair clogs. As shown, the ingress pumping module includes a prime pump 220 (e.g., a first stage of the multi-stage pump). In this example, the ingress pumping module 105 includes a one-way valve 205. As depicted, the ingress pumping module 105 includes an exit storage flow 125. The prime pump 220 may, for example, correspond to a first flow rate 615 (e.g., the prime pump 220 may be configured to provide the first flow rate 615).

The ingress system 105 includes a greywater source 120. The greywater source may, for example, include a shower. The greywater source may, for example, include a sink. In some embodiments the greywater source may, for example, be used in combination with a filter. The filter may, for example, be used to increase a number of greywater candidates (e.g., appliances from which greywater can be retrieved).

The ingress pumping module 105 may, for example, receive diversion signals. Diversion signals may, for example, include readings from high flow sensor 410 of shut off conditions (e.g., water reservoir is filled). The diversion signal may, for example, include sensors readings from the inbound fluid sensor 415, that the water level has stopped being detected and/or has dipped below a predetermined level suitable for greywater collection.

While the prime pump 220 is active and receiving detection from the inbound fluid sensor 415, the control system 515 may, for example, monitor the continuous flow from the sensor input 610. The sensor input may, for example, include feedback from a flow meter. The sensor input 610 may, for example, be monitored for a determination of continuous flow. The controller may, for example, compare predetermined durations selected via a user interface (UI) with the data collected from the sensor input. In some embodiments, the control system may, for example, compare predetermined durations to moderate and initiate higher rates of flow. In some embodiments, the control system may, for example, include prime pump retry/restart periods.

After the flow duration reaches the predetermined duration the prime pump may, for example, stop. The predetermined duration may, for example, be pre-selected for 5 seconds has been pre-selected of the continuous flow duration. The period may, for example, vary. The period may, for example, be changed by a user. The period may, for example, be 3 seconds. The period may, for example, be 4 seconds. The period may, for example, be 6 seconds. The period may, for example, be 7 seconds. In some examples, the period may be less than 3 seconds or more than 7 seconds.

The water dispensing appliance 120 is fluidly coupled to an ingress module 105. The ingress system includes a 2-stage pump module. The 2-stage pump, module may, for example, then trigger the high-speed pump 215. The ingress module 105 includes the prime pump 220. The prime pressure of the inbound flow 110 may, for example, be monitored by the flow sensor & meter 210. The flow sensor & meter 210 may, for example, include a hall flow sensor. The flow sensor & meter 210 may, for example, include an ultrasonic sensor in addition to a hall flow sensor. In some embodiments, an ultrasonic sensor may, for example, be included in the flow sensor & meter configuration. The flow sensor & meter 210 may, for example, include at least one sensor. The flow sensor & meter 210 may, for example, include multiple sensors. The flow sensor & meter 210 may, for example, include multiple types of sensors. The prime pressure of the inbound flow may, for example, be monitored in connection with the sensor input 415.

After a pre-selected duration of uninterrupted continuous inbound flow 110, the control system 515 may, for example, deactivate the prime pump 220. Then the high-speed pump 215 may, for example, continue to run until water is not detected by the inbound fluid sensor 415 and the flow sensor 210.

In some embodiments, when the flow sensor detects a lack of flow from the flow sensor 210, but the inbound fluid sensor 415 detects fluid, the system may, for example, re-engage the prime pump 220. The reengagement of the prime pump may, for example, maintain the prime negative pressure (e.g., suction). In some embodiments, the cycle may, for example, not be a full cycle restart. The engagement may, for example, assist the high-speed pump 215 to maintain the prime pressure.

The illustrative use-case scenario 100 includes an egress system 135. As shown, the fluid is configured to flow to the egress system 135 through the storage flow 125. In some embodiments, once either there is an interruption in the flow sensor and meter 210 and/or an interruption of the inbound fluid sensor 415, the cycle will end. The cycle may, for example, repeat once fluid is detected once-again by the inbound fluid sensor 415.

FIG. 2 is a schematic depicting an exemplary greywater capture and control system ingress. The ingress module includes a pump with an inlet. The inlet may, for example, be coupled to a suction line fluidly coupling the pump inlet to an existing drain port of a water dispensing appliance. The ingress pumping module may, for example, be configured such that, in response to flow accumulation in the drain port, the ingress pumping module automatically applies negative pressure to the drain port to divert the outflow of the drain port 120*a* from existing drain plumbing to a greywater reservoir 425.

The illustrative use-case scenario 100 includes an input-output (I/O device) communication device 230. The I/O device may, for example, be wired (as depicted in FIG. 1). The I/O device may, for example, be wireless (as depicted in FIG. 2).

In some embodiments, the I/O device may, for example, take the sensor inputs via wired the sensor may, for example, be hardwired to the I/O system. For wireless embodiment, the controller and automation systems may, for example, communicate wirelessly with other controllers and/or automation systems. Multiple Ingress systems may, for example, communicate with each other. The ingress system and egress system may, for example, work in combination with each other to fluidly transport water. In some embodiments, the greywater system may, for example, "network" water. The greywater system may, for example, transfer greywater to remote deployments over the lower diameter trickle tubing.

The I/O device may, for example, use a wireless network to communicate to a user interface device. The I/O device may, for example, communicate to a user interface module situated on the ingress device. The I/O device may, for example, include a series of input commands. The input commands may, for example, include a control button configuration. The I/O device may, for example, include a display screen. The control commands may, for example, be inputted by a touch screen device. The control commands may, for example, be controlled by mobile applications.

In some embodiments, the control commands may, for example, be entered by a remote monitoring service. Data may, for example, be measured of daily water use and transmitted to the ingress module controller. Data may, for example, then be transmitted to a third-party data storage region. The third-party data collection may, for example, be used to monitor water usage. The third-party data storage collection may, for example, be used in aggregate to monitor water usage of communities. The third-party data storage collection may, for example, be used to give personalized messages to improve water usage. The third-party data storage collection may, for example, set goals for users (e.g., recycle so many water units (e.g., gallons, liters, lbs, kgs, tons) per month. Users may, for example, receive community badges based on water usage. Users may, for example, receive rewards (e.g., accolades) based on water usage.

Figure 3:
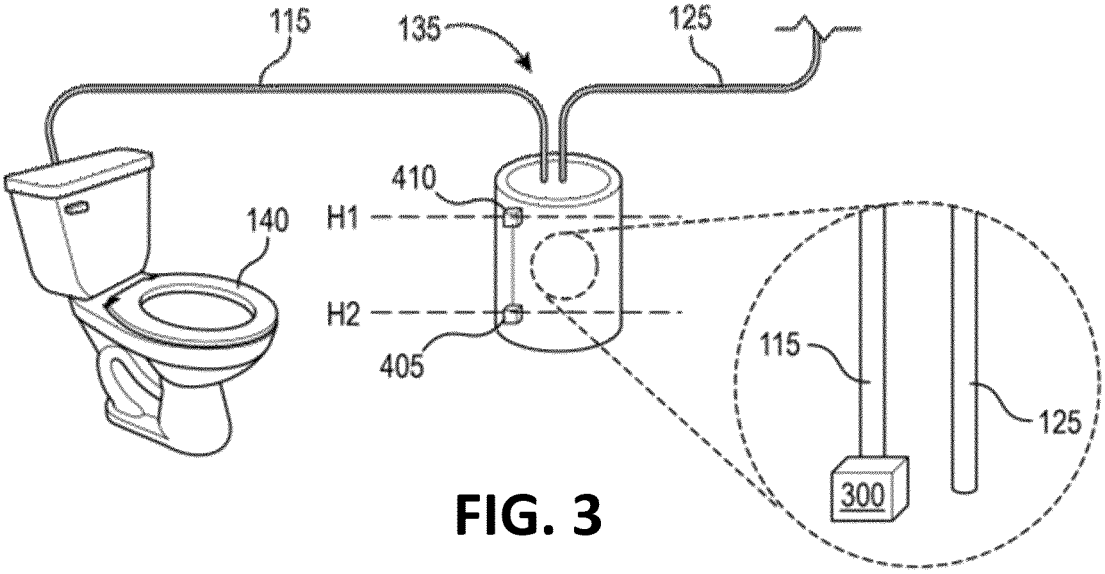
FIG. 3 is a schematic depicting an exemplary greywater capture and control egress system.

FIG. 3 is a schematic depicting an exemplary greywater capture and control egress system. In continuous ingress operation, the prior cycle of detecting and flowing fluid into the egress system 135 storage container through the storage flow 125 will inevitably fill the egress system's capacity to its limits and to control and regulate overflow. The continuous ingress operation may, for example, include determining the prior cycle of detecting. The operation may, for example, include maintaining prime pressure with the prime pump first flow rate and then cycling up to the second flow rate.

The control system 515 may, for example, constantly reading the high fluid sensor 410(located at a height H1) and low fluid sensor 405 (located at a height H2. If fluid meets or exceeds the level of the high fluid sensor 410, e.g., H1, the ingress system may, for example, stop intake of fluid until the level of fluid drops below the level the high fluid sensor 410, e.g., H1. The height H1 may, for example, be 10 inches. The height of H1 may, for example, be 20 inches. The height of H1 may, for example, vary based on the type of containers, and the amount of water intended for capture. The height of H2 may, for example, vary based on the type of containers, and the amount of water intended for capture.

In some embodiments, the automation and control system after a predetermined number cycles of full and empty will learn usage behavior and calculate & assess the intermediate levels of greywater remaining between H1 and H2. The learning of usage behavior for predicting when to balance the greywater fluid excess reserves between remote locations may, for example, be used to optimize the system. The system may, for example, provide early status messages to the end-user (e.g., via a smart phone message from an application and/or text) on optimization measures to maximize efficiency and usage.

In some embodiments, the fluid sensor(s) may, for example, be read on a schedule (e.g., predetermined designated times). For example, reading may occur at a predetermined repetition (e.g., every X milliseconds, every X seconds, every X minutes, every X hours, every X days). In some examples, the reading may occur continuously (e.g., analog, repeated as soon as possible).

The egress system 135 may, for example, trigger an outbound flow 125. After the egress system is triggered when the user has enabled operational mode in the UI 505. The outbound fluid sensor 420 in communication with the controller 705 does not detect fluid. The egress water system may, for example, transfer fluid via the outbound flow to a grey water destination 140. The grey water destination may, for example, include a toilet. The grey water destination may, for example, include yards. The grey water destination may, for example, include gardens. The grey water destination may, for example, include sprinkling systems. The grey water destination may, for example, include dishes washers coupled with a filter. The grey water destination may, for example, include laundry machines coupled with a filter.

In some egress system embodiments in a normal operational mode, when a no-fluid-found event has been established, the control system 515 may, for example, trigger the outbound pump 300 until the outbound fluid sensor 420 detects fluid upon which would complete the egress system 135 fill event on the outbound flow 115.

During this process the outbound sensor input 420 and control system 515 may, for example, be reading the low fluid sensor 405 and high fluid sensor 410 on an ongoing basis (e.g., continuously, repeatedly). If the low fluid sensor 405 detects an absence of fluid, then this signifies the egress system 135 is out of fluid and the control system 515 will stop the outbound pump 300 operation until the fluid level rises above the low fluid sensor 405. The height of the low fluid sensor may, for example, correspond to the height H2. The H2 height may, for example, be 1 inch. The H2 height may, for example, be 3 inches. The H2 height may, for example, be 4 inches. This prevents the outbound pump 300 from running dry and damaging the outbound pump 300. For example, at some point the ingress system 105 is fully operational and may detect fluid and further refill the egress system reservoir 425.

The greywater reservoir 425 may, for example, include the storage vessel. The greywater reservoir 425 may, for example, include the storage reservoir. The greywater reservoir 425 may, for example, include the egress system reservoir.

In some embodiments, the greywater capture and control system may, for example, capture (e.g., quickly) the greywater and store in the storage vessel. The ingress system may, for example, include an optical infrared sensor at the leading-edge that detects the presence of liquid and once that presence is detected the ingress process begins. The greywater capture and control system's storage vessel and monitoring system controller may, for example, be configured to monitor the water levels at the low-end and the high-end of the storage system. The controller may, for example, be included in the ingress system.

In some system embodiments, a storage and monitoring system may, for example, utilize two or more ultrasonic water sensors that may detect water through a plastic vessel of moderate thickness and any volume and range of physical dimensions to suit the space constraints of a physical space or room in homes, industrial and commercial locations. The plastic vessel may, for example, be ¾" thick The plastic vessel may, for example, be ½" thick. The plastic vessel may, for example, be ¼" thick. The plastic vessel wall thickness may, for example, have a thickness sufficient to support itself as a container. The sensor configuration may, for example, allows the system to utilize any type of plastic storage container for the storage vessel while the sensors (e.g., ultrasonic sensors) provide the monitoring functionality of the storage vessel.

In some embodiments, the ingress system may, for example, include two pumps to perform the function a) low velocity priming pump and b) a high velocity pump in addition to a water flow detection hall sensor and ultrasonic sensor. These flow sensors may, for example, be used once prime pressure has sufficiently risen to enable the high velocity pump to engage and more quickly draw-in greywater into the storage vessel in a reasonable and predetermined period during ingress cycles.

In some embodiments, the egress system and related components' functionality may, for example, include an egress pump for delivery of the greywater to the destination. The egress system may, for example, include an infrared sensor at the leading-edge to detect the presence of water much like a traditional mechanical water float valve will function to start/stop flow at a specified level, the egress infrared sensor read via software can moderate the egress pump to start/stop the flow of water towards the destination.

In some embodiments, the automation system and/or sensor systems may, for example, be designed and programmed to handle the fundamental ingress and egress flow operations. The greywater capture and control system may, for example, be configured with standardized settings and/or manufactured preference settings depending on use-case parameters. The automation system may, for example, be configured to include further customizations, settings, and/or options. These customization configurations may, for example, be configured to suit one or more localized applications. Such applications include, by way of example and not limitation, residential, commercial, industrial, and/or healthcare. Applications include, for example, bathrooms, kitchens, work areas, and/or other areas of greywater collection, storage, and/or distribution.

In some embodiments, may, for example, include a fluid intake module deployed in grey water source to selectively close existing drain port in response to fitting. In some embodiments, the grey water reservoir may, for example, be remote from the egress system. The egress pumping module may, for example, transfer water from the external water reservoir and transport it to different locations.

In some embodiments, the grey water capture and distribution system may, for example, include at least one ingress pumping module. The grey water capture and distribution system may, for example, use two ingress modules. The grey water capturing distribution system may, for example, use three ingress modules. The ingress pumping modules may, for example, be spatially distributed around a facility connected to corresponding drain ports. For example, at least 1 ingress pumping module may, for example, be located for each of plurality of rooms containing water dispensing devices. Some embodiments may, for example, include network of systems fluidly and communicatively coupled by rooms. Each system may, for example, communicatively couple to a user's phone via a mobile application. Smaller conduits may, for example, be used to allow lower flow, and longer durations of flow between local reservoirs.

In some embodiments, the grey water capture and distribution system may, for example, include an emergency drainage system and/or emergency shut off after grey water storage area has been filled. Water may, for example, stop being directed to the water reservoir after the high flow water sensor receives a water level detection of H2, e.g., water level at which reservoir is nearly filled.

Figure 4:
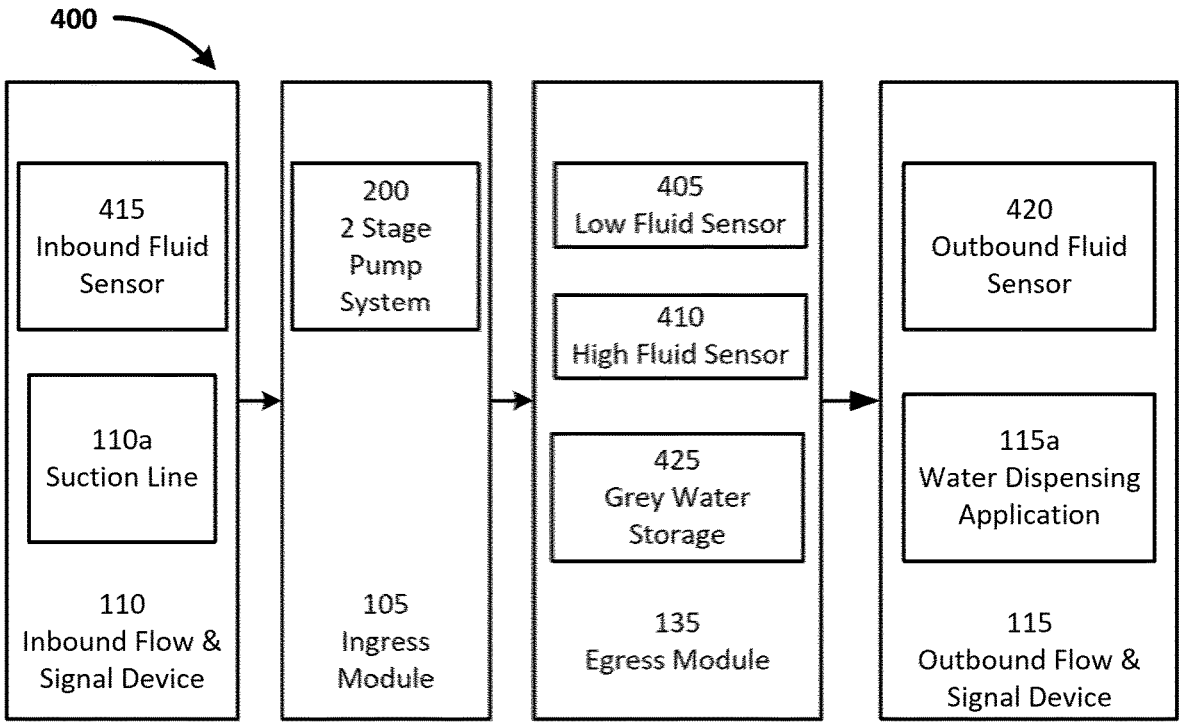
FIG. 4 depicts an exemplary greywater capture and control system flow block diagram

FIG. 4 depicts an exemplary greywater capture and control system flow block diagram 400. The flow block diagram includes the inbound flow and signal device 110. The inbound flow & signal device 110 includes a suction line 110*a*, which connects to the drain port of a water dispensing appliance. The inbound flow & signal device 110 includes an inbound fluid sensor 415, which detects the accumulation of greywater and triggers the system to begin its operation.

The ingress module 105 includes a 2-stage pump system 200, designed to manage the greywater flow, with the second stage activating when the flow exceeds a certain threshold to ensure efficient pumping and/or maintaining prime negative pressure.

Once the greywater is captured, the greywater moves into the egress module 135, which includes both a high fluid sensor 410 and a low fluid sensor 405. These sensors may, for example, monitor the levels of greywater in the storage to prevent overflow and ensure that the system may, for example, not run dry. The captured greywater is stored in grey water storage 425 for future use.

The outbound flow & signal device 115 includes an outbound fluid sensor 420, which detects when greywater is ready to be released from the storage, and a water dispensing application 115*a*, which facilitates the distribution of the greywater to its intended destination, such as for irrigation, appliances, and/or flushing toilets.

Figure 5:
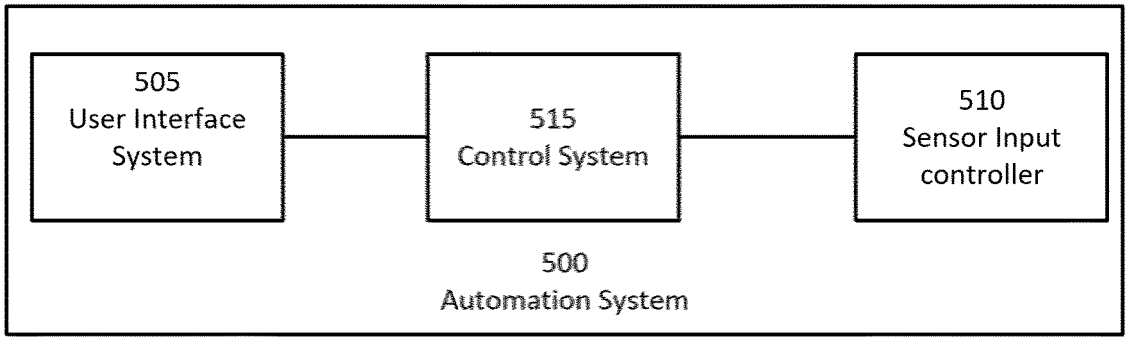
FIG. 5 depicts an exemplary greywater capture and distribution automation system block diagram.

FIG. 5 depicts an exemplary greywater capture and control automation system 500. The automation system 500 includes a user interface system 505. The user input and control mechanism may, for example, allow the user to configure, monitor, and/or adjust the settings of the greywater system. The U.I. system may, for example, provide the interface through which commands can be entered and data can be viewed in real-time. The U.I. system may, for example, be linked to a user's phone. The U.I. system may, for example, be linked to a mobile application. The mobile application may, for example, monitor local water savings.

The automation system 500 includes a sensor input controller 510. The sensor input controller may, for example, gather data from some sensors (e.g., fluid level sensors, flow sensors) integrated into the greywater system. The controller may, for example, allow for the automation of tasks like starting and/or stopping pumps and/or managing fluid levels.

The automation system 500 includes a control system 515 (e.g., CPU). The controller may, for example, manage and coordinate the greywater capture and distribution. The controller may, for example, communicates with both the user interface and the sensor inputs, making real-time decisions based on the data it receives.

FIG. 6 depicts an exemplary greywater capture and control block diagram 600. The block diagram includes a two stage pump flow 650. The two-stage pump flow may, for example, be facilitated by two separate pumps integrated into one pump module. The two-stage pump flow 650 includes a first stage 605. The first stage 605 operates at the first flow rate 615. The first flow rate 615 is directed to the storage flow 125. The first flow rate 615 may, for example, correspond to the prime pump 220.

The 2 stage pump flow 650 includes the second stage 630. The second stage 630 may, for example, operate when triggered to facilitate a second flow rate 635. The second flow rate may, for example, offer a higher flow rate to efficiently pump the greywater to the storage reservoir (e.g., in the egress module). The second flow rate 635 may, for example, correspond to the running of the high-speed pump 215. Although two stages are shown, more stages may, for example, be included. Stages may, for example, be added. Stages may, for example, be added by including additional high-speed pumps. Stages may, for example, be added by moderating pump speed. Pump sped may, for example, be moderated by using pulse width modulation for higher velocities and throughput. Pump speed may, for example, be moderated based on the deployed application.

The grey water distribution block diagram 600 includes an ingress pumping module 105. The ingress pumping module 105 include the pump module 200.

The grey water distribution block diagram 600 includes a predetermined period 640. The predetermined period is the set time duration that the system uses to control how long each stage of the pump operates. For example, once the flow reaches the threshold needed for the second Stage 630 to activate, the system runs the high-speed pump 215 for a specific period before the prime pump 220 automatically shuts off. This predetermined time may, for example, prevent over-pumping, ensures efficient water management, and avoids unnecessary energy use. The predetermine time may, for example, protect the pump from running continuously, which could lead to wear or damage.

The grey water distribution block diagram 600 includes a detection in drain port 610. The detection in the drain port may, for example, serve as an initial trigger that starts the entire pumping process. Once greywater is detected, the system activates the first stage 605, and the prime pump 220 begins to transfer the greywater into the system.

The grey water distribution block diagram 600 includes a flow threshold 620. The flow threshold may, for example, include the pre-defined value that determines when the system should switch from the first stage to the second stage of pumping. For example, after the greywater begins to flow, the flow sensor & meter 210 monitors the flow rate. Once the flow surpasses the threshold set by the system, it signals the control system 515 to activate the second stage 630. This may, for example, increase the flow rate through the high-speed pump 215, allowing the system to handle larger volumes of greywater. For example, the flow threshold may, for example, acts as a control mechanism to ensure that the second stage only activates when there is sufficient greywater.

FIG. 7 depicts an exemplary greywater capture and control user interface block diagram 700. The interface block diagram 700 includes the controller 705. The controller may, for example, manage the operation of the greywater system. The controller may, for example, receive data from various sensors and user inputs (e.g., I/O module 230), processes this information, and sends commands to the relevant components (e.g., pumps, valves) to regulate greywater flow. The controller may, for example, be used so that that all parts of the system work together based on real-time data from the sensors and user commands.

The interface block diagram 700 includes memory 710. The memory may, for example, store important data and instructions for system operation. The memory may, for example, include information needed to manage the greywater distribution system, user preferences, and/or historical data regarding water flow and sensor readings. The memory may, for example, retain the control algorithms that govern the system's automation processes, ensuring that the controller has the information it needs to make decisions.

The memory 710 includes a grey water distribution engine 715. The grey water distribution engine is a software module stored in the system's memory, responsible for managing the distribution of greywater. The greywater distribution engine may, for example, allow for greywater to be routed correctly from the greywater reservoir 425 and/or the egress module 135 to the appropriate destination (e.g., for irrigation, applications, and/or flushing) based on the input from the control system. The grey water distribution engine 715 may, for example, use real-time data to regulate the flow and distribution efficiently.

The memory 710 includes a user interface engine 720. The user interface engine may, for example, allow for communication between the user and the system. The user interface engine may, for example, be used in combination with the user interface system 505. The user interface engine 720 may, for example, allow users to input commands, monitor system performance, and adjust as needed. The user interface engine may, for example, ensure that the user interface is responsive and provides real-time feedback based on the system's operation.

The memory 710 includes an automation engine 725. The automation engine 725 may, for example, handle the automatic functionality of the greywater system. The automation engine may, for example, work alongside the control system 515 to manage the system's operation without the need for constant user input. The automation engine controls processes such as pump activation, sensor monitoring, and greywater distribution. The automation engine may, for example, allow for the system to run efficiently based on pre-programmed settings and real-time data from sensors.

The interface block diagram includes a negative pressure 730. The negative pressure may, for example, be facilitated by the ingress system 105 by creating negative pressure, the ingress system 105 may, for example, allow greywater to be efficiently drawn into the system for processing. Negative pressure 730 may, for example, be used to initiate the pump module 200, allowing the system to function without requiring manual intervention. In some embodiments, the greywater capture and control system may, for example, include a greywater and distribution system. The negative pressure may, for example, prevent any backflow. This may, for example, allow the water to move smoothly into the greywater reservoir for further distribution.

In some embodiments, the inbound flow & signal device may, for example, include a sonar sensor. The sonar sensor may, for example, detect fluid levels or submerged objects using sound waves. The sonar sensor may, for example, be used to detect water flow through hair.

In some embodiments, the inbound flow & signal device may, for example, include an Infrared (IR) sensor. The IR sensor may, for example, be used to detect water flow. In some embodiments, the inbound flow & signal device may, use a combination of sensors. The In some embodiments, the inbound flow & signal device may, use a combination of an IR sensor and a sonar sensor. The sonar sensor may, for example, be configured to detect water levels and/or flow. The IR sensor may, for example, be used to detect water levels and/or flow. The sensors may, for example, work together to monitor and determine water level and/or water flow.

For example, if one sensor is obstructed by hair, the combination of sensors may, for example, work together to determine water and/or flow, although one of the sensors is obstructed.

Figure 8:
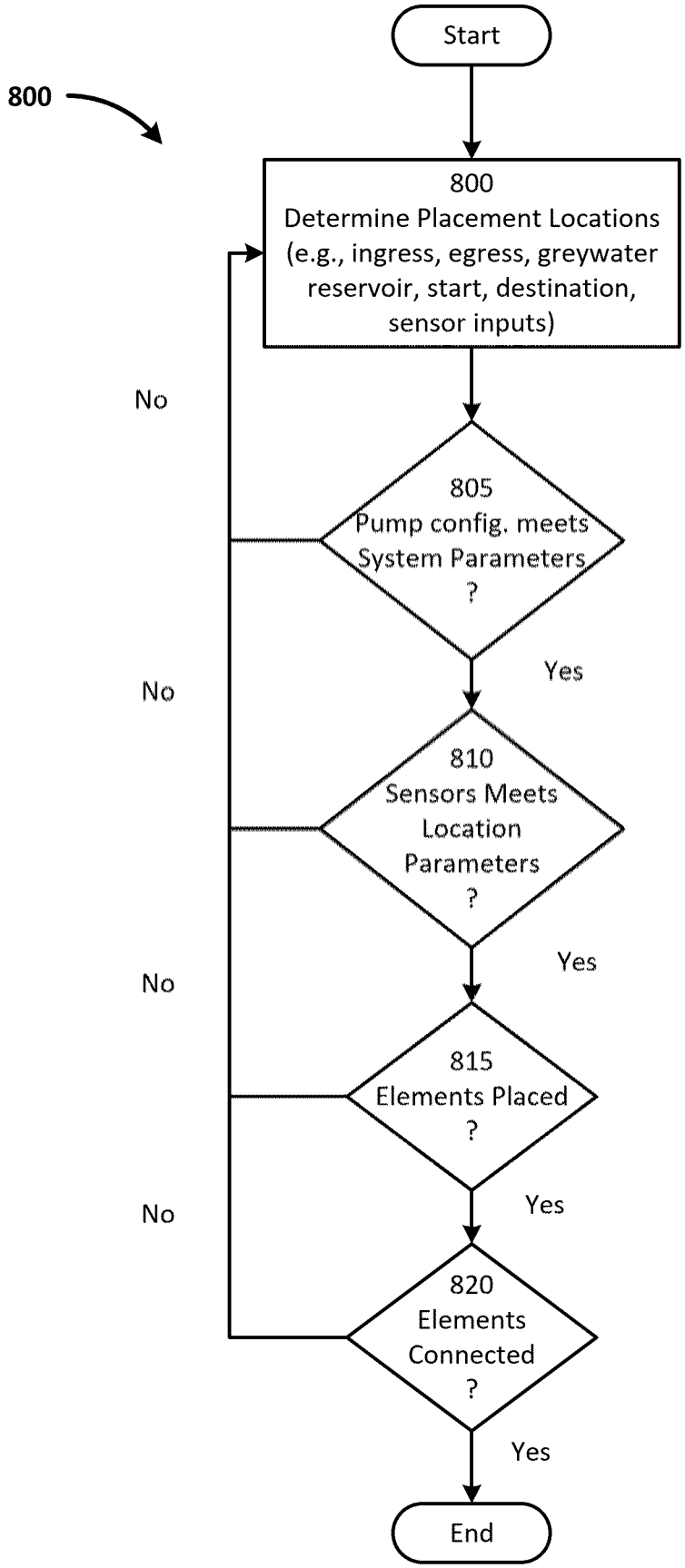
FIG. 8 depicts an exemplary greywater capture and control installation process.

FIG. 8 depicts an exemplary greywater capture and control installation process 800. The greywater capture and control system may, for example, be used for gathering, storing and distributing greywater. The greywater capture and control system may, for example, be used in a device that is fully automatic in the capture, storage and distribution of greywater. In Step 800, the user determines placement locations for key system components like the ingress, egress, reservoir, and sensors. In Step 805, the user checks if the pump configuration meets system parameters such as flow rate and pressure. In Step 810, the user verifies that drop in suction lines & sensors and water dispensing applications & sensors are correctly placed to monitor greywater levels and flow rates. In Step 815, the user ensures that all system elements, including ingress, egress, fluid outflow lines, fluid inflow lines, and sensors, are properly placed and in communication with each other. In step 820, the user confirms that all elements are communicatively coupled, turned on/and/or powered, and fluid integration and seal for system operation is complete.

FIG. 9 depicts a process 900 for controlling the operation of the prime and high-speed pumps in the greywater system.

In step 905, the system receives a signal indicating that greywater has been detected. This detection triggers the process to begin the pumping sequence. In step 910, upon receiving the water detection signal, the system actuates the prime pump to start drawing greywater into the system. The prime pump initiates the flow at a lower rate to build pressure in the system.

In step 915, the system monitors the flow rate and checks whether it has reached a predefined threshold within a certain period. If the flow rate meets the threshold, the system moves to the next step; otherwise, it continues running the prime pump. In step 920, if the threshold flow rate is met, the system actuates the high-speed pump, increasing the flow rate to efficiently transfer the greywater. This step may, for example, allow the system to handle larger volumes of greywater quickly.

In step 925, after the high-speed pump is activated, the system again monitors whether the threshold flow rate is sustained for the predetermined period. If the flow rate is maintained, the system proceeds to the next step. In step 930, once the high-speed pump takes over and the flow threshold is met, the system stops the prime pump to prevent unnecessary operation and conserve energy.

In step 935, the system checks if the input detection signal (indicating greywater) has stopped. If no more greywater is detected, it prepares to stop the pumps. If water is still detected, the process continues. In step 940, once the greywater input detection fully stops, the system confirms that no more water is being detected in the system, signaling the end of the pumping cycle.

In step 945, with no more water detected, the system stops the high-speed pump, completing the greywater pumping process and shutting down the system until the next water detection event.

Figure 10:
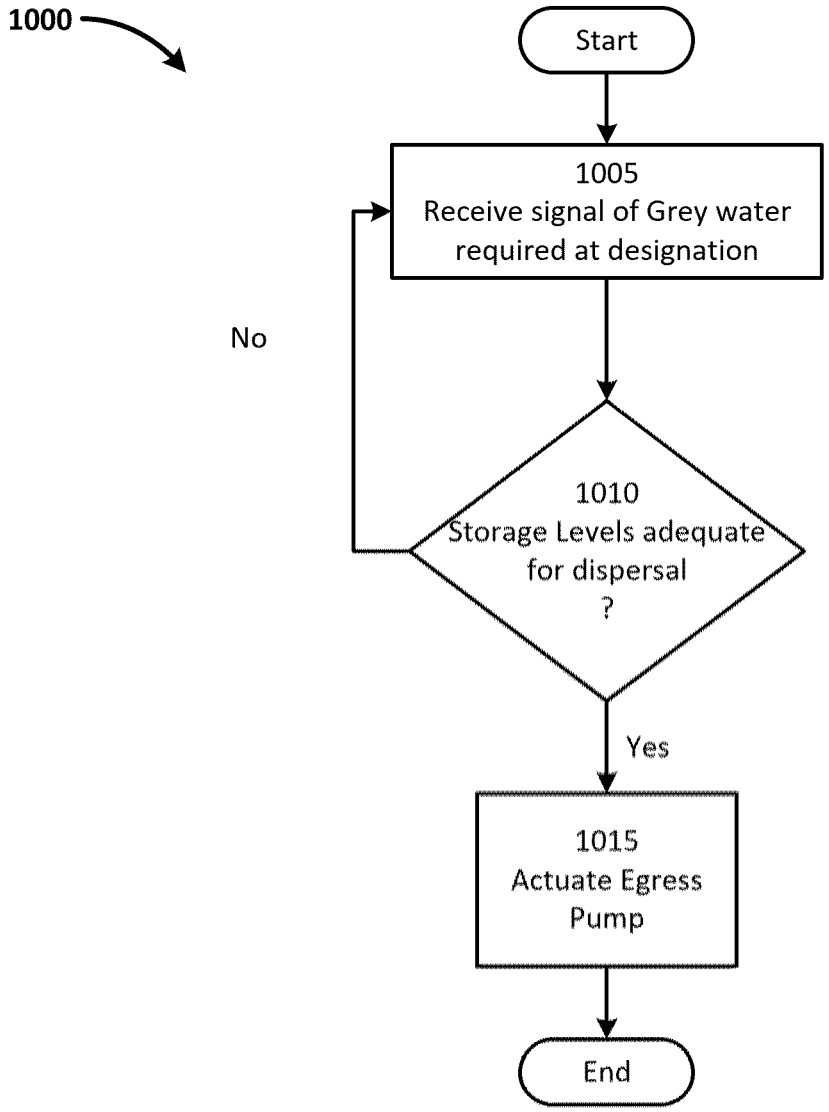
FIG. 10 depicts an exemplary greywater capture and control egress system process.

FIG. 10 depicts an exemplary greywater capture and control egress system process 1000. In step 1005, the system receives a signal indicating that greywater is needed at a specific destination (e.g., for irrigation, applications, and/or flushing toilets). This triggers the system to assess whether the greywater can be supplied. In step 1010, the system checks the greywater reservoir to determine if there is a sufficient amount of stored greywater to meet the demand. If the storage level is inadequate, the system will loop back and wait until the level is sufficient. In step 1015, If the storage level is adequate, the system actuates the egress pump, which begins dispersing the greywater to the designated location.

Figure 11:
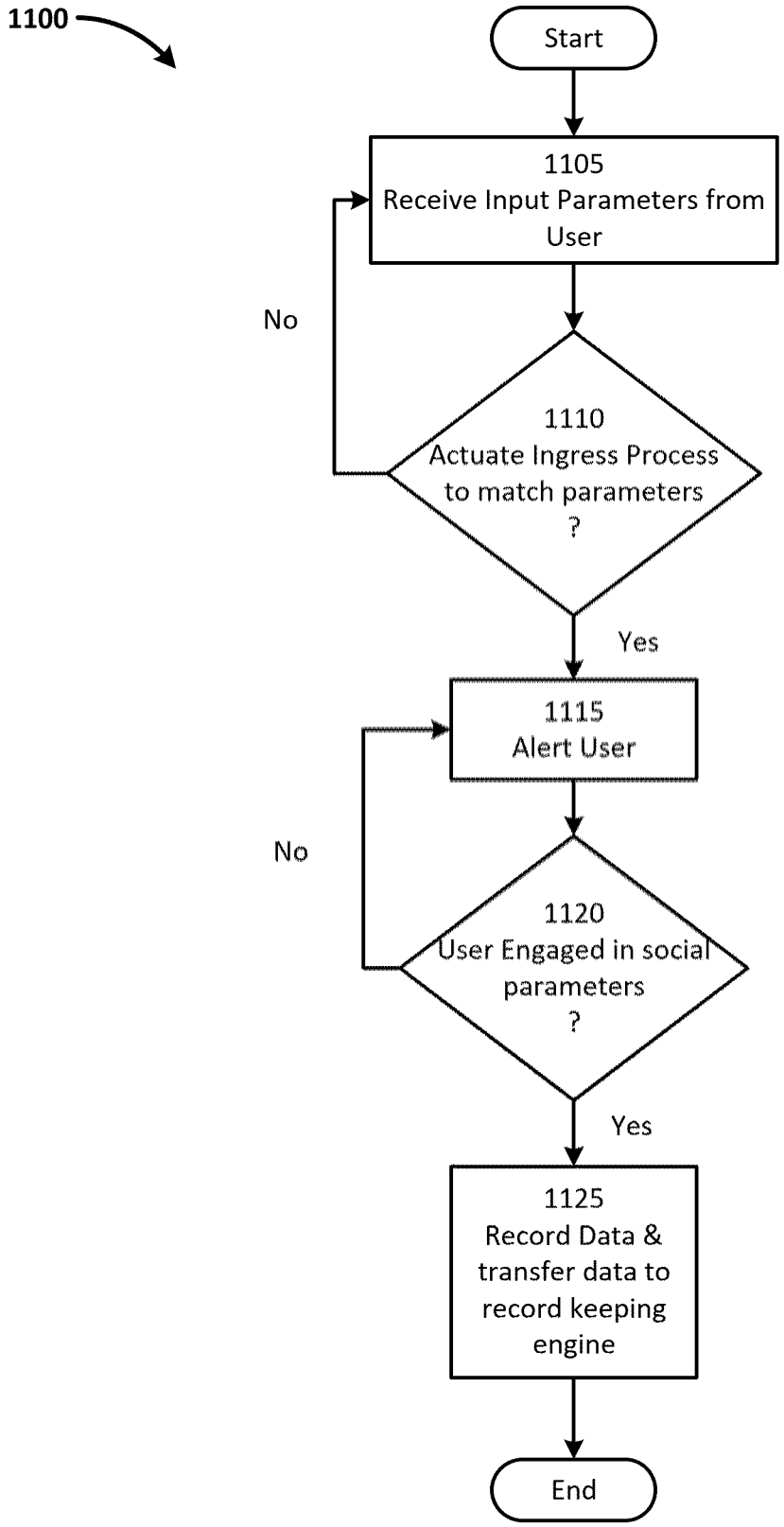
FIG. 11 depicts an exemplary greywater capture and control user interface system process.

FIG. 11 depicts an exemplary greywater capture and control user interface system process 1100.

In step 1105, the system starts by receiving specific input parameters from the user. These parameters could relate to the greywater system's operation and/or user preferences for how the system should function.

In step 1110, the system checks whether it can actuate the ingress process based on the input parameters provided by the user. If the parameters match system capabilities, the ingress process is initiated; otherwise, the system loops back to recheck the input.

In step 1115, once the ingress process has been actuated to match the user parameters, the system sends an alert to notify the user that the process has been successfully initiated and is functioning.

In step 1120, the system checks if the user has activated any social parameters, which could refer to engagement in community-based settings, challenges, or social tracking metrics for water usage (such as environmental goals or social initiatives). If the user is engaged, the system proceeds to record data.

In step 1125, if social parameters are engaged, the system records relevant data and transfers it to a record-keeping engine. This may include tracking the user's water usage, participation in social challenges, and/or other metrics, which can be used for reporting or gamification purposes.

For context, Greywater may be described as run-off water from sources such as showers, sinks, and washing machines, as well as many other non-consumption water sources. The greywater may be intended for reuse in cleaning, flushing, and other non-potable activities. Other greywater systems, may, for example, greywater focus on custom-built, large-scale designs focused primarily on greywater collection and storage. Other systems may, for example, require a complex array of plumbing modifications tailored to each site's specific needs. In many cases, other system may, for example, involve significant fixture alterations, creating a barrier to adoption due to the extensive and/or costly installation process. Other systems, may, for example, be dysfunctional due to complexity and lack of standardization in existing greywater systems limited their scalability and broad market acceptance.

For context, other grey water systems may, for example, be characterized by their need for customization based on the topology of each unique environment. Other greywater systems may, for example, resulted in higher costs due to the bespoke nature of their design and installation, which hindered economies of scale. Other greywater systems have a necessity of plumbing modifications in many environments, especially in multi-unit or high-rise buildings, which may, for example, require approvals from governing authorities, adding further regulatory barriers.

The greywater capture and control system may, for example, provide a standardized, self-contained greywater device that takes minutes to install and once deployed enables the environmental and economic benefits of greywater.

The greywater capture and control system may, for example, lower the cost of a greywater device as a purpose-built device allows economies of scale to take effect. The greywater capture and control system may, for example, allow more households and businesses to participate in the benefits of recycling their water into greywater.

The greywater capture and control system may, for example, consolidate numerous functions into a self-contained device that enables water re-usability into usable greywater without the complications of plumbing modifications.

The greywater capture and control system may, for example, use water which previously only functioned with fresh potable water to be dropped-in to allow for accepting greywater with the automatic functionality of the greywater capture and control system device.

The greywater capture and control system may, for example, be used to expand the potential for water and environmental conservation and utility of greywater in a multitude of applications.

For context, in recent years, the cost of single-purpose hardware and software components has decreased significantly. The greywater capture and control system has allowed more single-purpose hardware devices Internet of Things (IoT) to emerge more economically. The greywater capture and control system may, for example, include inherent features that may monitor and manage home and commercial resources more seamlessly and efficiently than traditional non-IoT automated methods.

For context, the greywater capture and control system may, for example, leverage IoT devices. IoT device may, for example, allow for more self-sufficiency and provide a level of service that was previously unavailable and at a much more economically viable level. The greywater capture and control system may, for example, provide many such hardware and software IoT features to remain economically viable and simple to use in function.

The greywater capture and control system may, for example, overcome major existing barriers to greywater system adoption by modifying existing plumbing systems. Existing barriers may, for example, include: cost, extensive pluming modifications and permitting.

The IoT enabled design of this greywater capture and control system may, for example, bypass the existing plumbing system entirely and through its onboard sensors and hardware and software combination, has capabilities and functionality to seamlessly bypass existing plumbing infrastructure. This allows for greywater distribution activities as if it were behaving as a component of the original plumbing infrastructure by seamlessly collecting the greywater and distributing the greywater at each site of the devices deployment.

Although various embodiments have been described with reference to the figures, other embodiments are possible.

Although an exemplary system has been described with reference to FIG. 1-11, other implementations may be deployed in other industrial, scientific, medical, commercial, and/or residential applications.

In industrial applications, the greywater capture and control system may, for example, be used to enhance water efficiency in large-scale manufacturing facilities. The system may collect greywater from industrial equipment such as washing systems or cooling units, diverting it to a greywater reservoir for future reuse. In these environments, the system integrates with existing infrastructure without requiring significant plumbing changes, optimizing installation time and minimizing costs. The system's integration with Internet of Things (IoT) technology may, for example, allow for real-time monitoring and adjustment of water usage based on operational requirements. This approach may reduce dependence on freshwater supplies.

In scientific applications, the greywater capture and control system may, for example, be used in research facilities where water conservation is important. The system may, for example, captures greywater from sinks and equipment, treating it for reuse in non-potable applications. This feature may, for example, offer a modular solution that may be integrated with laboratory systems, allowing for greywater system functions with minimal disruptions to experiments. The IoT functionality may, for example, allow for detailed tracking of water use, providing data for research on resource conservation and sustainability practices.

In medical applications, the greywater capture and control system may, for example, be used in healthcare facilities to reduce water waste from sterilization and sanitation procedures. The system may, for example, collect greywater from autoclaves and washing units, diverting it for non-potable uses such as irrigation or facility cleaning. This may, for example, allow healthcare providers to achieve water savings while maintaining standards of hygiene and sanitation. The system may, for example, be installed without significant plumbing modifications. This may, for example, reduce disruptions in high-demand environments such as hospitals. The IoT integration may, for example, provide facility managers with real-time data on water usage, allowing for informed decisions on resource management.

In commercial applications, the greywater capture and control system may, for example, be installed in retail and hospitality spaces to reduce water consumption. The system may, for example, capture greywater from appliances like dishwashers, laundry machines, and sinks, reusing it for irrigation or flushing toilets. The greywater capture and control system may, for example, allow for straightforward installation in both new and existing buildings. The IoT connectivity may, for example, allows business owners to monitor water usage remotely, providing the ability to adjust usage based on demand.

In residential applications, the greywater capture and control system may, for example, be used to recycle water from household appliances such as sinks, showers, and washing machines. Homeowners may, for example, benefit from reduced utility costs by reusing greywater for purposes like irrigation and/or toilet flushing. The system's ease of installation and self-contained design may, for example, make it accessible for a wide range of users. IoT integration may, for example, allow residents to monitor water usage through mobile devices, providing insights into savings and water efficiency. The system may, for example, encourage sustainable living by reducing household water consumption, helping to address water scarcity concerns.

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Although an example of a system, which may be portable, has been described with reference to the above figures, other implementations may be deployed in other processing applications, such as desktop and networked environments.

Temporary auxiliary energy inputs may be received, for example, from chargeable or single use batteries, which may enable use in portable or remote applications. Some embodiments may operate with other DC voltage sources, such as a 9V (nominal) batteries, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device. The display device may, for example, include an LED (light-emitting diode) display. In some implementations, a display device may, for example, include a CRT (cathode ray tube). In some implementations, a display device may include, for example, an LCD (liquid crystal display). A display device (e.g., monitor) may, for example, be used for displaying information to the user. Some implementations may, for example, include a keyboard and/or pointing device (e.g., mouse, trackpad, trackball, joystick), such as by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A fluid distribution system comprising:

an ingress pumping module comprising a pump with an inlet;

a suction line fluidly coupling the pump inlet to an existing drain port of a water dispensing appliance;

a grey water reservoir remote from the ingress pumping module; and, a controller in operable communication with an fluid intake module comprising at least one sensor on the grey water reservoir to determine a fill level of the grey water reservoir;

wherein the controller, in response to receiving a fill level signal from the fluid intake module, selectively shuts off the ingress pumping module in response to a diversion signal from the controller; and, the ingress pumping module comprises two stages configured such that: in response to detection of flow in the drain port, a first stage activates at a first flow rate and, when flow through the ingress pumping module is detected to have surpassed a minimum flow threshold for a predetermined period, then a second stage activates at a second flow rate higher than the first flow rate.

2. A fluid distribution system comprising:

a remote ingress pumping module from an existing drain port and greywater reservoir comprising a pump with an inlet comprising:

a plurality of stages configured such that:

in response to detection of flow in the drain port, then a first stage activates at a first flow rate and, in response to detection of flow through the ingress pumping module having surpassed a minimum flow threshold for a predetermined period, then a second stage activates at a second flow rate higher than the first flow rate; and, a suction line fluidly coupling the pump inlet to the existing drain port of a water dispensing appliance, wherein the ingress pumping module is configured such that, in response to flow accumulation in the drain port, the ingress pumping module automatically applies negative pressure to the drain port to divert an outflow of the drain port from existing drain plumbing to a greywater reservoir.

3. The fluid distribution system of claim 2, wherein a first inlet of suction line is coupled to the existing drain port by a filter.

4. The fluid distribution system of claim 2, wherein a first inlet further comprises a sensor.

5. The fluid distribution system of claim 4, wherein the first inlet further comprises a pressure sensor.

6. The fluid distribution system of claim 4, wherein the first inlet further comprises a sonar sensor.

7. The fluid distribution system of claim 4, wherein the first inlet further comprises a light sensor.

8. The fluid distribution system of claim 4, wherein the first inlet further comprises an optical sensor.

9. The fluid distribution system of claim 4, wherein the first inlet further comprises a fluid level sensor.

10. The fluid distribution system of claim 4, wherein the first inlet further comprises a water contact sensor.

11. The fluid distribution system of claim 2, further comprising a plurality of ingress pumping modules, each ingress pumping module spatially distributed around a facility connected to corresponding drain ports.

12. The fluid distribution system of claim 2, further comprising at least 1 ingress pumping module for each of a plurality of grey water sources.

13. The fluid distribution system of claim 2, further comprising an egress pumping module comprising:

a grey water reservoir housing fluidly connected to the ingress pumping module and a greywater destination;

at least one egress sensor placed to detect water level within the greywater reservoir housing; and, an outbound pump within the grey water reservoir housing configured to divert water to the greywater destination through a water dispensing application after receiving a signal from an outflow sensor directing flow placed at the greywater destination.

14. The fluid distribution of claim 2, further comprising a controller in operable communication with an fluid intake module comprising at least one sensor on the grey water reservoir to determine a fill level of the grey water reservoir, then the controller, in response to receiving a fill level signal from the fluid intake module, selectively shuts off the ingress pumping module in response to a diversion signal from the controller.

15. A grey water device comprising:

an ingress pumping module comprising a pump with an inlet;

a suction line fluidly coupling the pump inlet to an existing drain port of a water dispensing appliance; and, a controller in operable communication with an fluid intake module comprising at least one sensor on a grey water reservoir to determine a fill level of the grey water reservoir;

wherein the controller, in response to receiving a fill level signal from the fluid intake module, selectively shuts off the ingress pumping module in response to a diversion signal from the controller;

wherein the ingress pumping module is configured such that, in response to flow accumulation in the drain port, the ingress pumping module automatically applies negative pressure to the drain port to divert an outflow of the drain port from existing drain plumbing to the greywater reservoir; and, the ingress pumping module comprises two stages configured such that: in response to detection of flow in the drain port, a first stage activates at a first flow rate and, when flow through the ingress pumping module is detected to have surpassed a minimum flow threshold for a predetermined period, then a second stage activates at a second flow rate higher than the first flow rate.

* * * * *